US005937769A

United States Patent [19]

Hyun

[11] Patent Number: 5,937,769

[45] Date of Patent: Aug. 17, 1999

[54] FIRE GRATES HAVING INTIMATE-CONTACT PREVENTING MEANS THEREON

[76] Inventor: Kwangsoo Hyun, SUT 8-30 Nhoyoo-1-Dong/Kwangjin-Gu, Seoul, 143-301, Rep. of Korea

[21] Appl. No.: 08/803,496

[22] Filed: Feb. 20, 1997

Related U.S. Application Data

[63] Continuation-in-part of application No. 08/535,407, Sep. 28, 1995, Pat. No. 5,701,881, which is a continuation-in-part of application No. 08/373,959, Jan. 17, 1995, abandoned, which is a division of application No. 08/128,071, Sep. 28, 1993, abandoned.

[51] Int. Cl.[6] ..... F23G 5/00

[52] U.S. Cl. ..... 110/248; 110/166; 126/152 B; 126/182

[58] Field of Search ..... 126/152 R, 152 B, 126/182, 540, 163 A, 163 R; 110/247, 248, 275, 166

[56] References Cited

U.S. PATENT DOCUMENTS

| | | | |
|---|---|---|---|
| 277,754 | 5/1883 | Lucas | 126/152 R |
| 1,497,490 | 6/1924 | Dullmann | 126/152 R |
| 2,393,422 | 1/1946 | Schneider | 110/275 |
| 3,191,591 | 6/1965 | Bennett | 126/152 R |
| 3,424,145 | 1/1969 | Stitt | 126/152 R |
| 4,924,847 | 5/1990 | Patenaude . | |

FOREIGN PATENT DOCUMENTS

| | | | |
|---|---|---|---|
| 600780 | 2/1926 | France | 126/52 R |

*Primary Examiner*—Henry Bennett
*Assistant Examiner*—Susanne C. Tinker

[57] ABSTRACT

A variety of essentially circulr-planform fire grates having ash discharge openings therein and intimate-contact preventing means thereon is presented. The intimate contact preventing means for the fire grate having upper surface contour of fluctuation-free profile in the circumferential direction of the fire grate comprises first fluctuation-free-bottom spider-web-planform fins having fin upper surface of fluctuation-free profile and second fluctuation-free-bottom spider-web-planform fins having fin upper surface of fluctuational profile. The intimate contact preventing means for the fire grate having upper surface contour of fluctuational profile in the circumferential direction of the fire grate comprises first fluctuational-bottom spider-web-planform fins having fin upper surface of fluctuation-free profile and second fluctuational-bottom spider-web-planform fins having fin upper surface of fluctuational profile. Also presented are generally polygonal-planform stationary fire grates having ash discharge openings therein and intimate-contact preventing means. The intimate contact preventing means for the fire grate having upper surface contour of fluctuational profile in one Cartesian coordinate direction comprises first fluctuational-bottom straight fins having fin upper surface of fluctuation-free profile and second fluctuational-bottom straight fins having fin upper surface of fluctuational profile. The intimate contact preventing means for the fire grate having upper surface contour of fluctuation-free profile in one Cartesian coordinate direction comprises first fluctuation-free-bottom straight fins having fin upper surface of fluctuation-free profile and second fluctuation-free-bottom straight fins having fin upper surface of fluctuational profile.

5 Claims, 10 Drawing Sheets

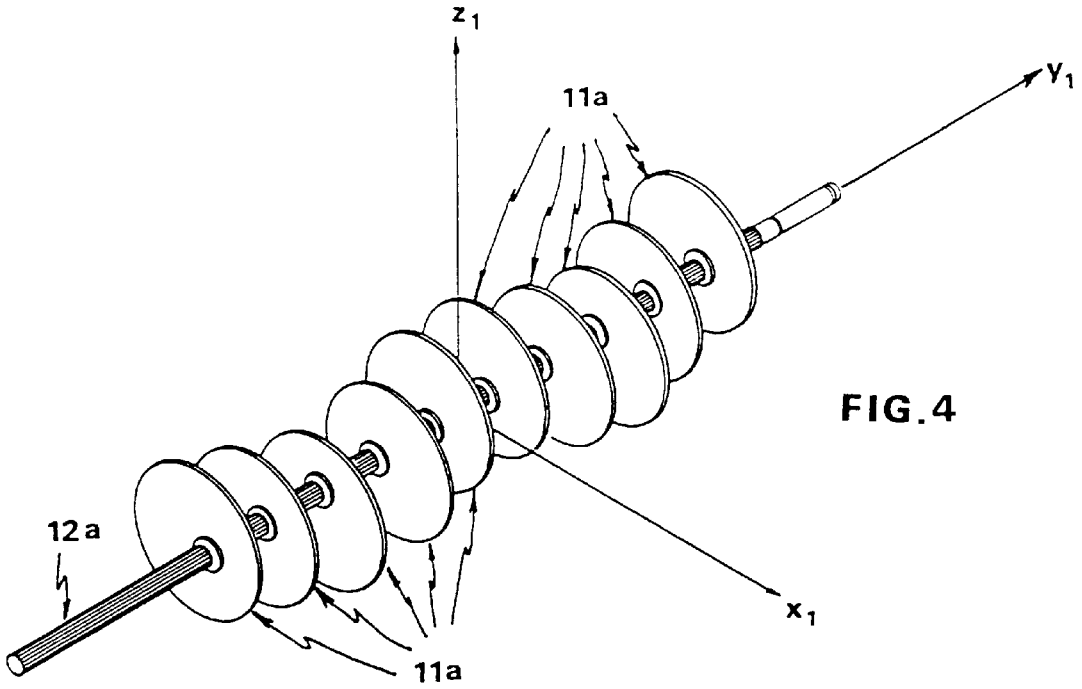
FIG. 4
FIG. 13
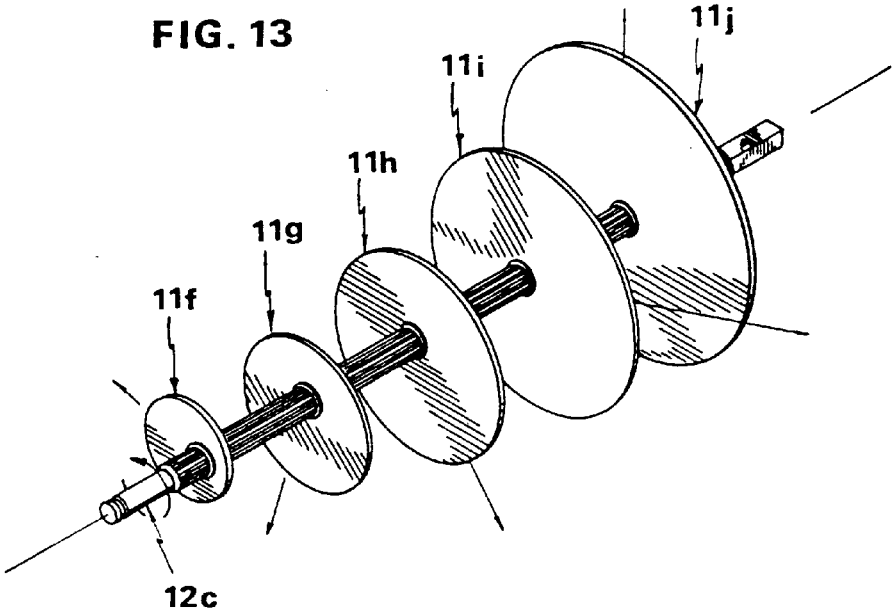

x
10
14e
20f
20d
13r
13r
14e
20e
20d
13r
13r
14c
13q
14d
20d
20d
14c
13r
13p
20c
14b
13p
13p
20b
14b
14f
13s
14f
13p
20a
14b
13p
y
z
10

FIG. 15
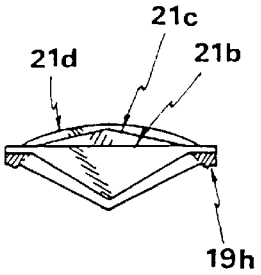
FIG. 17
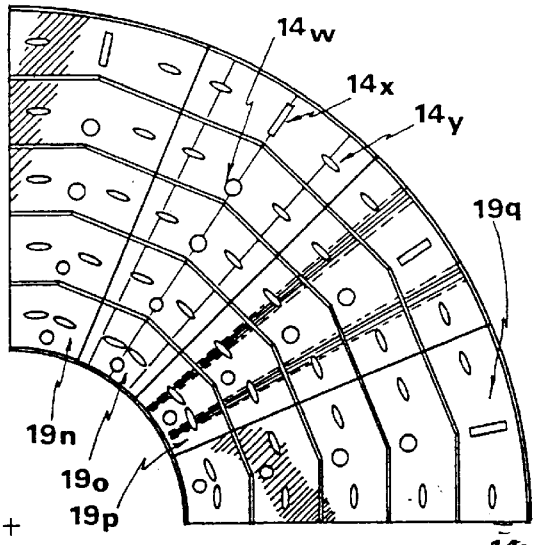
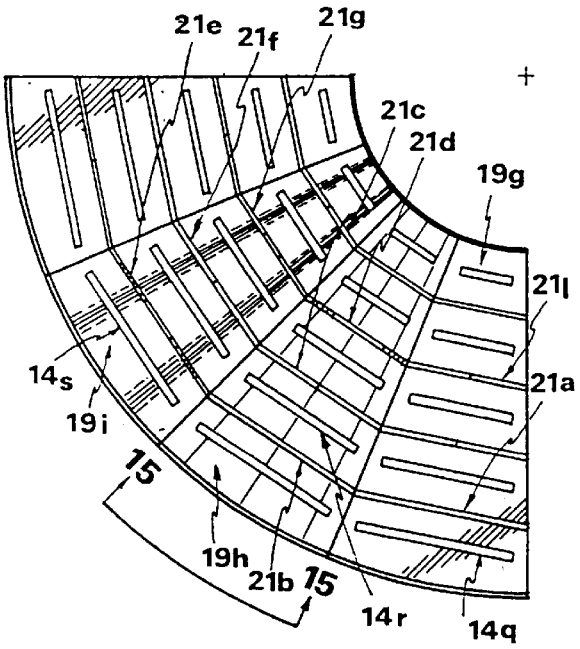
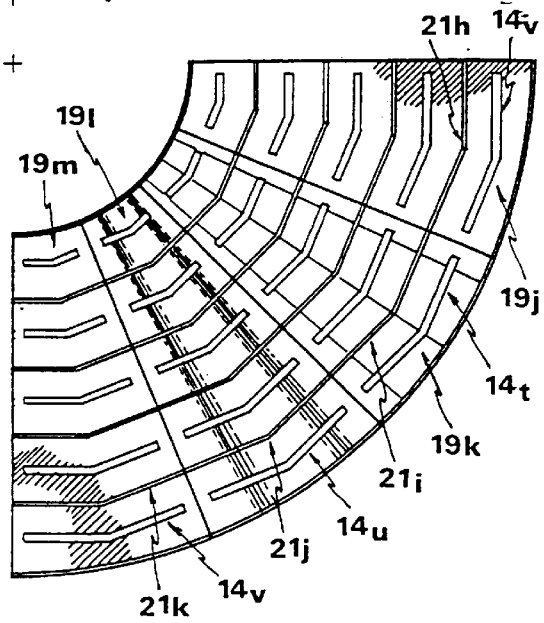
FIG. 14
FIG. 16

FIRE GRATES HAVING INTIMATE-CONTACT PREVENTING MEANS THEREON

CROSS-REFERENCES

The present application is a continuation in part of my application Ser. No. 08/535,407 filed Sep. 28, 1995, entitled "Fire Grate Having Fluctuational Profile in Circumferential Direction Thereof, " now U.S. Pat. No. 5,701,881, which was also a continuation in part of my abandoned application Ser. No. 08/373,959 filed Jan. 17, 1995, now abandoned, which was a divisional application of Ser. No. 08/128,071 filed Sep. 28, 1993, entitled "Merry-Go-Round Agitation Fire Grate Module for Household and Industrial Waste Incinerator Furnaces," now abandoned.

BACKGROUND

The present invention relates to a stationary fire grate having circular or square planform thereof, which is placed in the low region of the incineration chamber of an incinerator furnace.

Up to the present time, the circular stationary fire grate used in refuse-burning incinerator furnaces has been of basically plain circular-late type grate with circular holes or fan-shaped planform openings therein to provide discharge passage to ash sifting of the waste materials being burned on the fire grate and/or air passage therethrough from underneath to supply combustion supporting air to the waste material dumps on the fire grate. Even with intimate-contact preventing means on the single-body circular fire grate such as U.S. Pat. No. 4,924,847, there is no central and/or radially laid out and circumferentially and integrally disposed means for supporting the fire grate to prevent deterioration of structural stiffness of the fire grate exposed to extreme heat of the furnace operating temperature so that application of those embodiments on the incinerator furnace with circular incineration chamber having inside diameter of up to three or four meters to have big incineration capacity is impossible.

Due to high cost of manufacture of rigorous agitation mechanism in the conventional circular planform fire grates for provision of wide enough refuse-air contact areas to meet stoichiometric condition in the incineration chamber and also due to poor reliability of the rotary grate owing to complicated and thus costly structures thereof, there has been a need for square planform fire grates having a unidirectional agitational means therein.

On the other hand, there has been a need for provision of agitational effect to stationary fire grates irrespective of planform shape of the fire grates. U.S. Pat. No. 27,876 shows an embodiment of corrugated fire grate upper surface profile in one direction of the fire grate. This embodiment is, however, not provided with said intimate-contact preventing means thereon and with air admission holes through which combustion supporting air is admitted from underneath the fire grate so that application of this fire grate is limited to small size incineration furnace if applied in the incineration chamber of an incineration furnace.

Due to the above mentioned negative features and limitations of the conventional stationary fire grates, scaling up in diameter of the incineration chamber of the incinerator furnaces wherein the fire grate is implemented to take care of massive incineration of municipal and industrial refuses has been restricted to small size incineration furnace, which is mainly due to the deterioration of the structural rigidity at high furnace operating temperature. Under these circumstances, the advent of stationary fire grate provided with intrinsic intimate-contact preventing means for providing larger air space between the refuse fuel being incinerated thereon and the upper surface of the fire grate has been anticipated to achieve less number of parts used for a large capacity incinerator furnace while maintaining agitational effect and structural rigidity at elevated temperature ranges irrespective of the planform shape of the fire grate, resulting in low cost both in manufacture and in maintenance thereof and in enhanced reliability.

SUMMARY

The present invention is intended to overcome the above described disadvantages of the conventional circular or square planform fire grate of which upper surface is of essentially fluctuation-free profile.

An object of this invention is to provide intimate-contact preventing means for having the refuse materials incinerated on the fire grate virtually airborne for providing extra refuse-air contact spaces so that larger refuse-air contact area is achieved for a given refuse volume.

To achieve the object described above, a variety of spider-web planform fins and straight fins in accordance with the present invention has been integrally disposed on the upper surface of the essentially circular and rectangular or other polygonal planform stationary fire grates respectively. The upper surface of the fire grate whereon the intimate contact preventing means is provided is either fluctuational or fluctuation-free in one direction of each of the two species of planform of the fire grates.

The first version of the invention is an essentially circular sectoral-planform stationary fire grate having at least one ash discharge opening therein and means thereon for preventing refuse fuel being burned thereon from making intimate contact with upper surface of the fire-grate, contour of the fire-grate upper surface being of fluctuation-free profile in circumferential direction of the fire grate. The intimate-contact preventing means comprises at least one selected from a group consisting of: (a) at least one sectoral first fluctuation-free-bottom spider-web-planform fin having fin upper-surface contour of fluctuation-free profile and fin lower-surface contour of the same fluctuation-free profile as the profile of the contour of the fire-grate upper surface in the circumferential direction, the first fin being integrally disposed on the fire-grate upper surface such that center of planform thereof essentially coincides with that of the fire grate; and (b) at least one sectoral second fluctuation-free-bottom spider-web-planform fin having fin upper-surface contour of fluctuational profile and fin lower-surface contour of the same fluctuation-free profile as the profile of the contour of the fire-grate upper surface in the circumferential direction, the second fin being integrally disposed on the fire-grate upper surface such that center of planform thereof essentially coincides with that of the fire grate.

The second version of the invention is an essentially circular sectoral-planform stationary fire grate having at least one ash discharge opening therein and means thereon for preventing refuse fuel being burned thereon from making intimate contact with upper surface of the fire-grate, contour of the fire-grate upper surface in circumferential direction and in radial direction of the fire grate being of fluctuational profile and of fluctuation-free profile respectively. The intimate-contact preventing means comprises at least one selected from a group consisting of: (a) at least one sectoral first fluctuational-bottom spider-web-planform fin having fin upper-surface contour of fluctuation-free profile and fin lower-surface contour of the same fluctuational profile as the profile of the contour of the fire-grate upper surface in the circumferential direction, the first spider-web-planform fin being integrally disposed on the fire-grate upper surface such that center of planform thereof essentially coincides with that of the fire grate; and (b) at least one sectoral second fluctuational-bottom spider-web-planform fin having fin upper-surface contour of fluctuational profile and fin lower-surface contour of the same fluctuational profile as the profile of the contour of the fire-grate upper surface in the circumferential direction, the second spider-web-planform fin being integrally disposed on the fire-grate upper surface such that center of planform thereof essentially coincides with that of the fire grate.

The third version of the invention is a stationary fire grate having at least one ash discharge opening therein and at least four sides of planform thereof such that at least one pair of two sides of the at least four sides is essentially parallel to each other. Contour of the fire-grate upper surface is of fluctuational profile such that distance on the planform of the fire grate from one of the sides to a point on the fire-grate upper surface where the fire-grate upper surface has the lowest elevation varies in magnitude thereof in a direction essentially parallel to one of the sides.

The fourth version of the invention is a stationary fire grate having at least one ash discharge opening therein, means thereon for preventing refuse fuel being burned thereon from making intimate contact with upper surface of the fire-grate, and at least four sides of planform thereof such that at least one pair of two sides of the at least four sides is essentially parallel to each other, contour of the fire-grate upper surface being of fluctuational profile in a direction essentially normal to one of the sides The intimate-contact preventing means comprises at least one selected from a group consisting of: (a) at least one first fluctuational-bottom straight fin having fin upper surface contour of fluctuation-free profile and fin lower surface contour of the same profile as the profile of the contour of the fire-grate upper surface, the first straight fin being integrally disposed essentially normal to one of the sides on the fire-grate upper surface: and (b) at least one second fluctuational-bottom straight fin having fin upper surface contour of fluctuational profile and fin lower surface contour of the same profile as the profile of the contour of the fire-grate upper surface, the second straight fin being integrally disposed essentially normal to one of the sides on the fire-grate upper surface.

The fifth version of the invention is a stationary fire grate having at least one ash discharge opening therein, means thereon for preventing refuse fuel being burned thereon from making intimate contact with upper surface of the fire-grate, and at least four sides of planform thereof such that at least one pair of two sides of the at least four sides is essentially parallel to each other, contour of the fire-grate upper surface being of fluctuation-free profile in a direction essentially normal to one of the sides. The intimate-contact preventing means comprises at least one selected from a group consisting of: (a) at least one first fluctuation-free-bottom straight fin having fin upper surface contour of fluctuation-free profile and fin lower surface contour of the same fluctuation-free profile of the contour of the fire-grate upper surface, the first fluctuation-free-bottom straight fin being integrally disposed essentially normal to one of the sides on the fire-grate upper surface; and (b) at least one second fluctuation-free-bottom straight fin having fin upper surface contour of fluctuational profile and fin lower surface contour of the same fluctuation-free profile of the contour of the fire-grate upper surface, the second fluctuation-free-bottom straight fin being integrally disposed essentially normal to one of the sides on the fire-grate upper surface.

In practicing the invention, one mode of manufacture is to make a wood pattern for a fan-shaped angular sector of the invented circular-planform fire grate. Another recommended mode of manufacture which is especially cost effective in having a wide range of planform diameters of the fire grates is to make radial fractional wood patterns for the above described fan-shaped angular sector for provision of add-on capability for successively increasing fire-grate planform diameters for a fire grate of a specific cycle numbers in accordance with the present invention.

BRIEF DESCRIPTION OF THE DRAWINGS

These and other versions, features and many of the attendant advantages of this invention will be appreciated more readily as the same become better understood from a reading of the following detailed description when considered in connection with the accompanying drawings, wherein similar parts, openings or holes in each of the several figures are identified by the same reference character selectively with lower case alphabetical character suffixed thereto also together with a numeral additionally suffixed thereto to indicate a portion of an element or different planform under same name, and wherein:

FIG. 4 is a perspective view of an agitation rotor for the stoker of FIG. 1;

FIG. 13 is a perspective view of an agitation rotor for the stoker of FIG.

FIG. 14 is a plan view of two sectoral fire grates having first and second fluctuation-free-bottom spider-web-planform fins thereon and two sectoral fire grates having both of the first and second fluctuational-bottom spider-web-planform fins thereon in accordance with the first and second version of the fire grate of the present invention respectively;

FIG. 15 is a radial view of the fire grate taken along 15—15 of FIG. 14;

FIG. 16 is a plan view of two sectoral fire grates having thereon the first and second fluctuation-free-bottom spider-web-planform fins with alternative planform thereof and two sectoral fire grates having thereon the first and second fluctuational-bottom spider-web-planform fins with alternative planform thereof in accordance with the first and second version of the fire grate of the present invention respectively; and Finally, FIG. 17 is a plan view of four sectoral fire grates of FIG. 16 with alternative ash discharge openings therein.

DETAILED DESCRIPTION OF THE PREFERRED EMBODIMENTS

Figure 1:
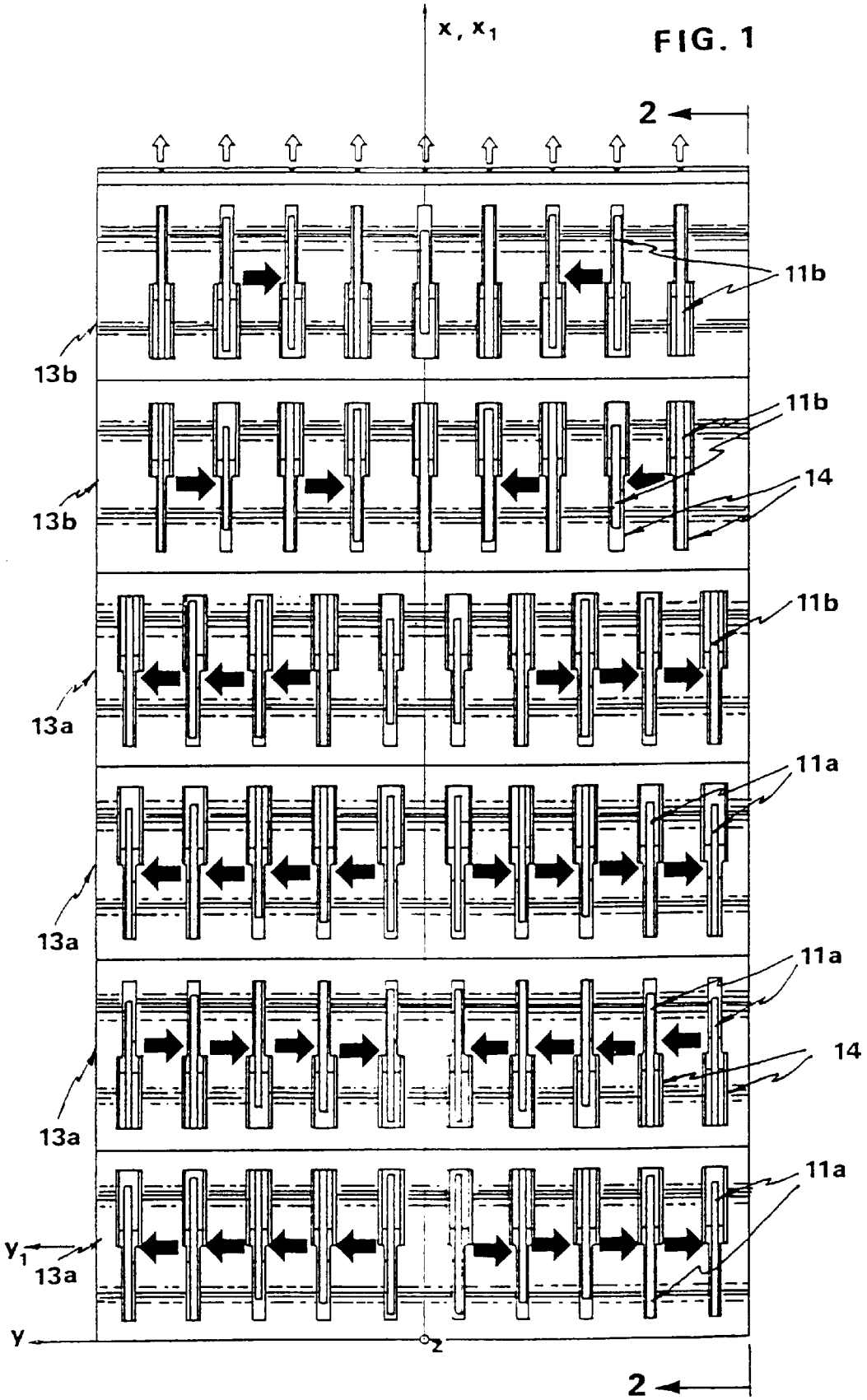
FIG. 1 is a plan view of an agitational stoker taken in the combustion chamber of an incinerator furnace wherein a stationary fire grate having rectangular planform thereof and fluctuational profile in longitudinal direction of the stoker is illustrated.

FIG. 1 is a plan view of an agitational stoker taken in the combustion chamber of an incinerator furnace wherein stationary rectangular-planform fire grates 13*a*, 13*b* are mounted on several mutually parallel coolant-cooled combustion-agent supply pipings in accordance with the present applicant's invention Contour of the fire-grate upper surface is of fluctuational profile in "x" direction.

Figure 2:
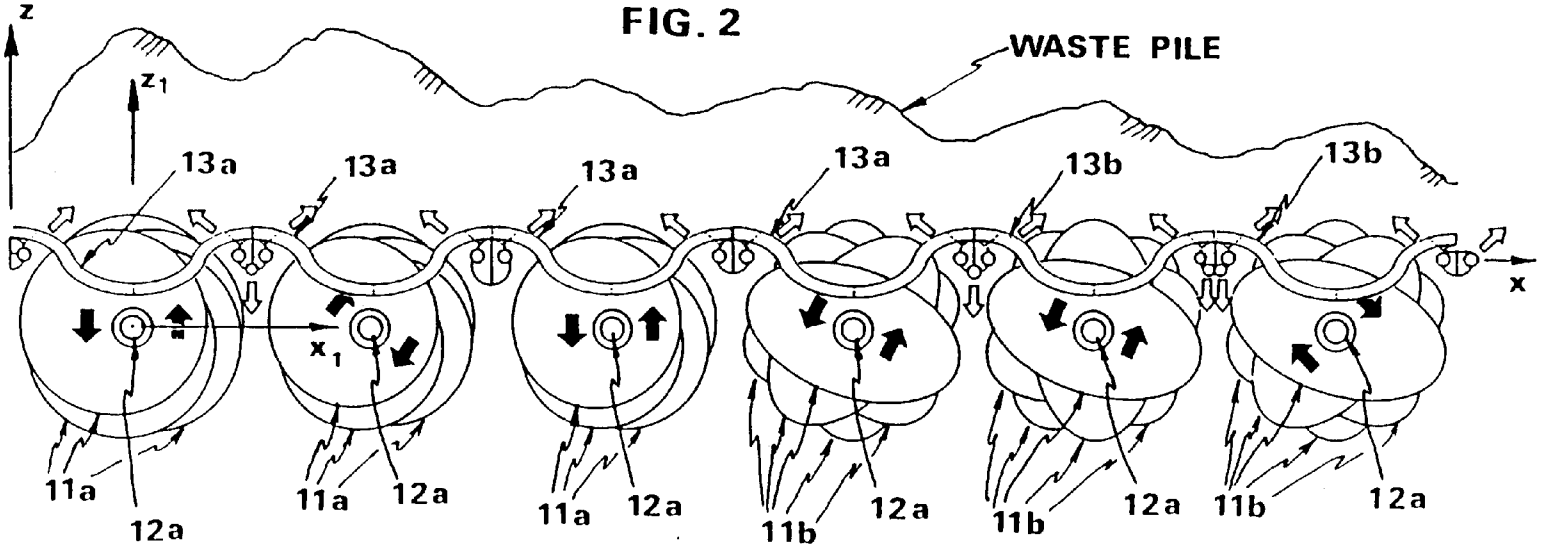
FIG. 2 is a sectional view vertically taken along 2—2 of FIG. 1.

FIG. 2 is a sectional view vertically taken along 2—2 of FIG. 1. The waste pile on the rectangular-planform fire grates is lifted upward when combustion supporting agent, inclusive of air, is admitted into the incineration chamber from underneath the fire grate through combustion-agent openings disposed on each combustion-agent piping of the combustion-agent supply pipings supporting rectangular-planform fire grates. The first through sixth, and seventh fire-grate-supporting piping cross section from left are cross sectional embodiments to the combustion-agent supply pipings. On the other hand, waste fuel is getting moved in "y" direction (indicated in black arrows in FIG. 1) as well as in "x" direction as each of agitation rotor shafts 12*a* with a plurality of agitation discs 11*a*, 11*b* secured thereon is rotationally driven either in counterclockwise or in clockwise direction. Each of the first through third agitation discs 11*a* has one cycle of fluctuational agitational motion a revolution thereof while each of the fourth through sixth agitation discs 11*b* has two cycles of the fluctuational agitational motion per revolution thereof. The ash discharge as well as combustion-agent admission is made through ash discharge openings 14 (shown in FIG. 1) in each of the fire grates 13*a*, 13*b*.

Figure 3:
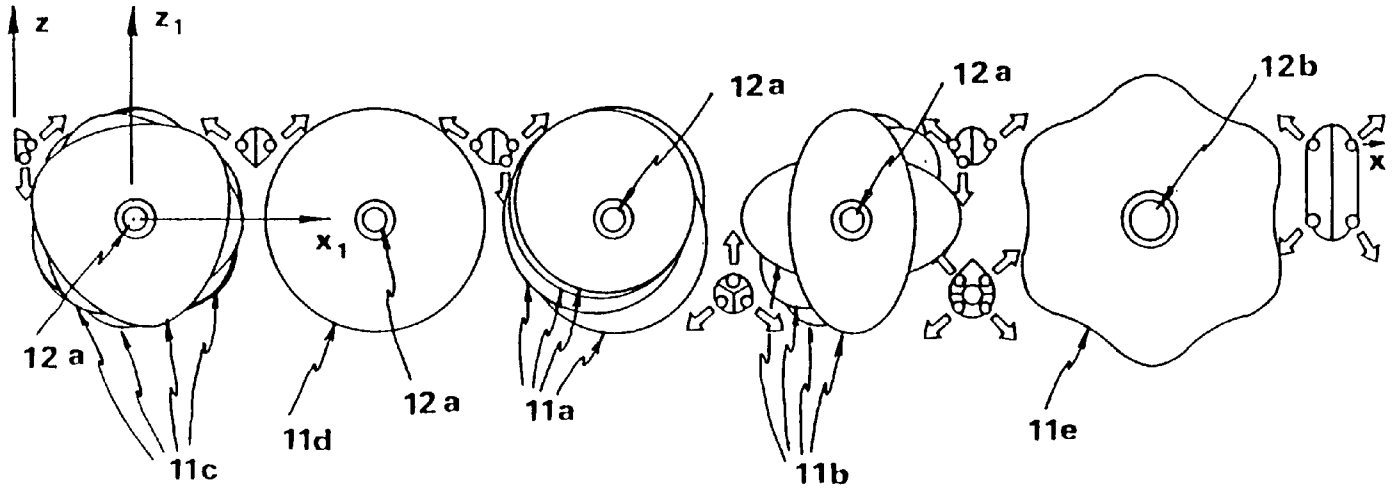
FIG. 3 shows an alternative disposition of other coolant-cooled combustion-agent supply pipings as means for supporting fire grates of the present invention.

FIG. 3 shows an alternative disposition of cross-sectional embodiments to other coolant-cooled combustion-agent supply pipings. The first agitation disc 11*c* performs three fluctuational agitational motion per revolution thereof while the second through fifth agitation disc 11*d*, 11*a*, 11*b*, 11*e* conducts infinite, one, two, and six fluctuational agitational motion every revolution thereof respectively.

FIG. 4 is a perspective view of an agitation rotor shaft 12*a* of the first agitation rotor of FIG. 1 with ten agitation discs 11*a* secured thereto. Mutually neighboring two agitation discs 11*a* has 72 deg. phase angle shift with respect to each other in securing to the agitation rotor shaft 12*a*.

Figure 5:
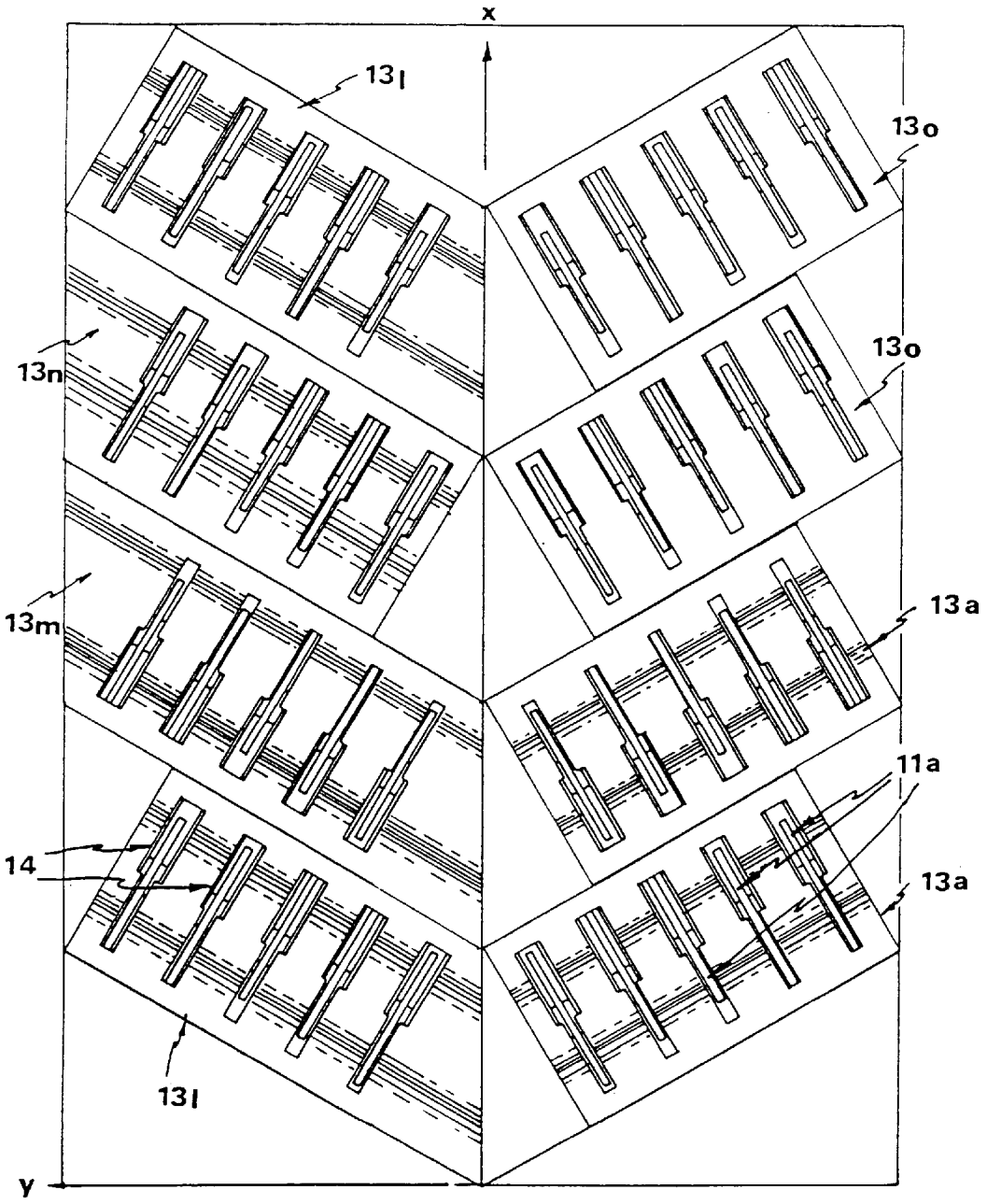
FIG. 5 is a plan view of an another layout of the fire grates and the agitation rotor taken in the combustion chamber of an incinerator furnace, wherein stationary rectangular-planform and other alternative planform fire grates in accordance with the present invention are mounted.

FIG. 5 is a plan view of another layout of the fire grates in accordance with the present and the agitation rotors taken in the combustion chamber of an incinerator furnace, wherein stationary rectangular-planform and other alternative planform fire grates 13*a*, 131, 13*m*, 13*n*, 13*o* are mounted. Here, the rectangular planform fire grate 13*o* has contour of fire-grate upper surface of fluctuation-free profile.

Figure 6:
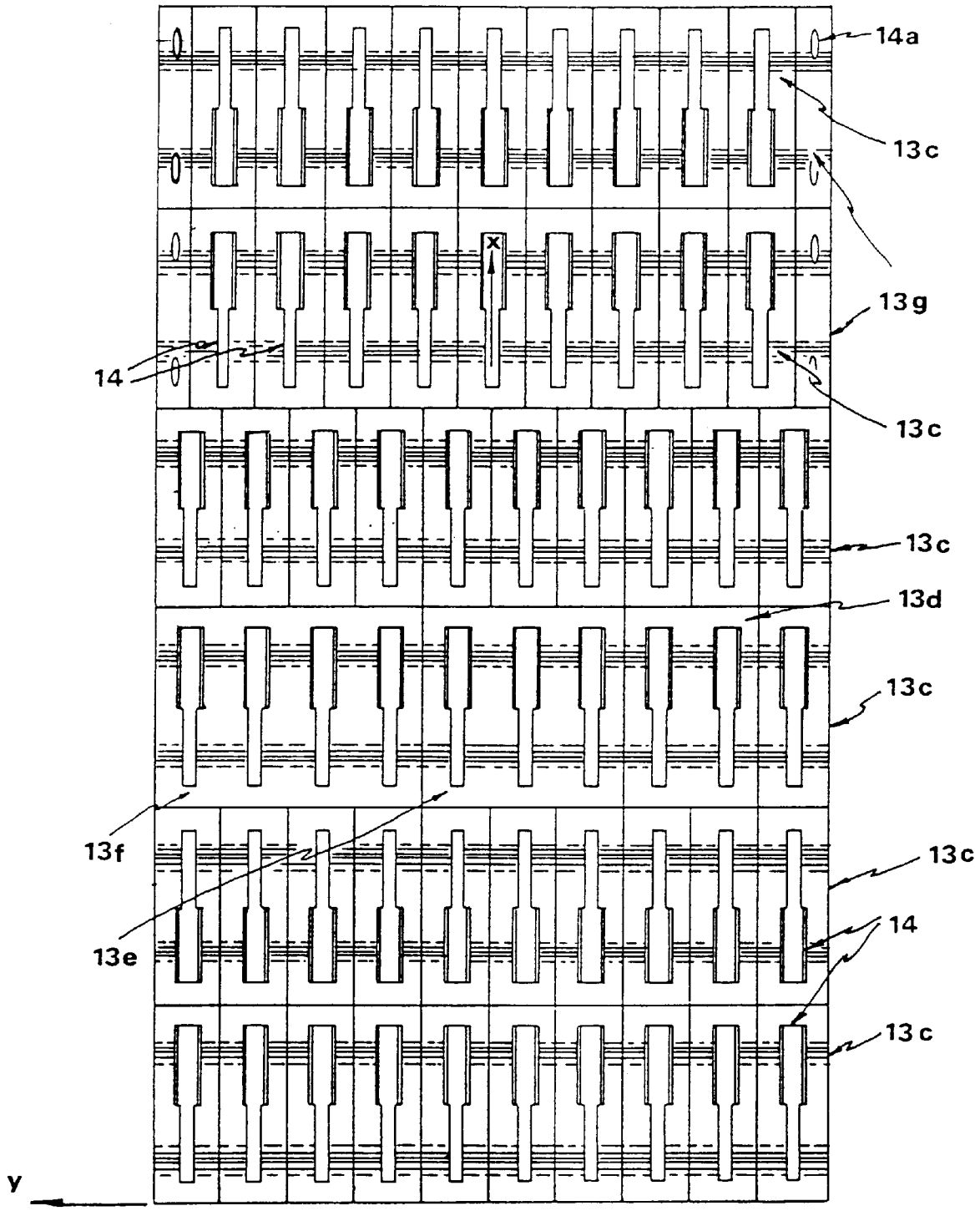
FIG. 6 is a plan view of a commercial mode of the rectangular-planform fire grates in accordance with a commercial mode of the present invention of FIG. 1.

FIG. 6 is a plan view of rectangular-planform fire grates 13*c*, 13*d*, 13*e*, 13*f*, 13*g* in accordance with some commercial modes of the present invention. Contour of each of the rectangular-planform fire grates is of fluctuational profile in a direction normal to bottom edge of planform of each of the grates.

Figure 7:
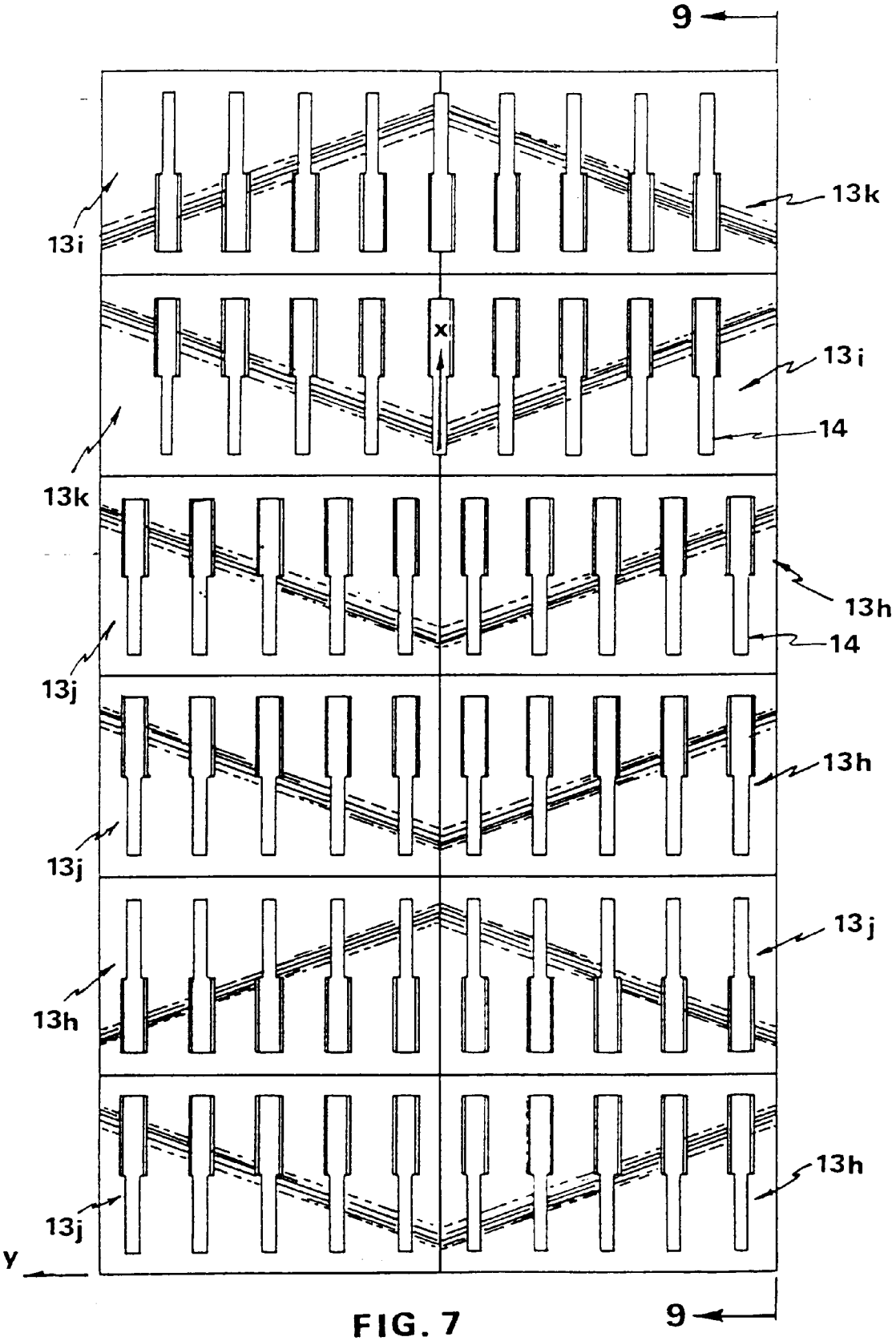
FIG. 7 is a plan view of the third version of the fire grate of the present invention, wherein profile of the fire-grate upper surface is of fluctuational profile in both of planform directions.

FIG. 7 is a plan view of rectangular-planform fire grates 13*h*, 13*i*, 13*j*, 13*k* in accordance with the third version of the fire grate of the present invention. Contour of the fire-grate upper surface is of fluctuational profile in "y" direction as well as in "x" direction. The ash discharge openings 14 are for mating with the agitation discs 11. Other embodiments of ash discharge openings may be made for a stoker with or without agitational features.

Figure 8:
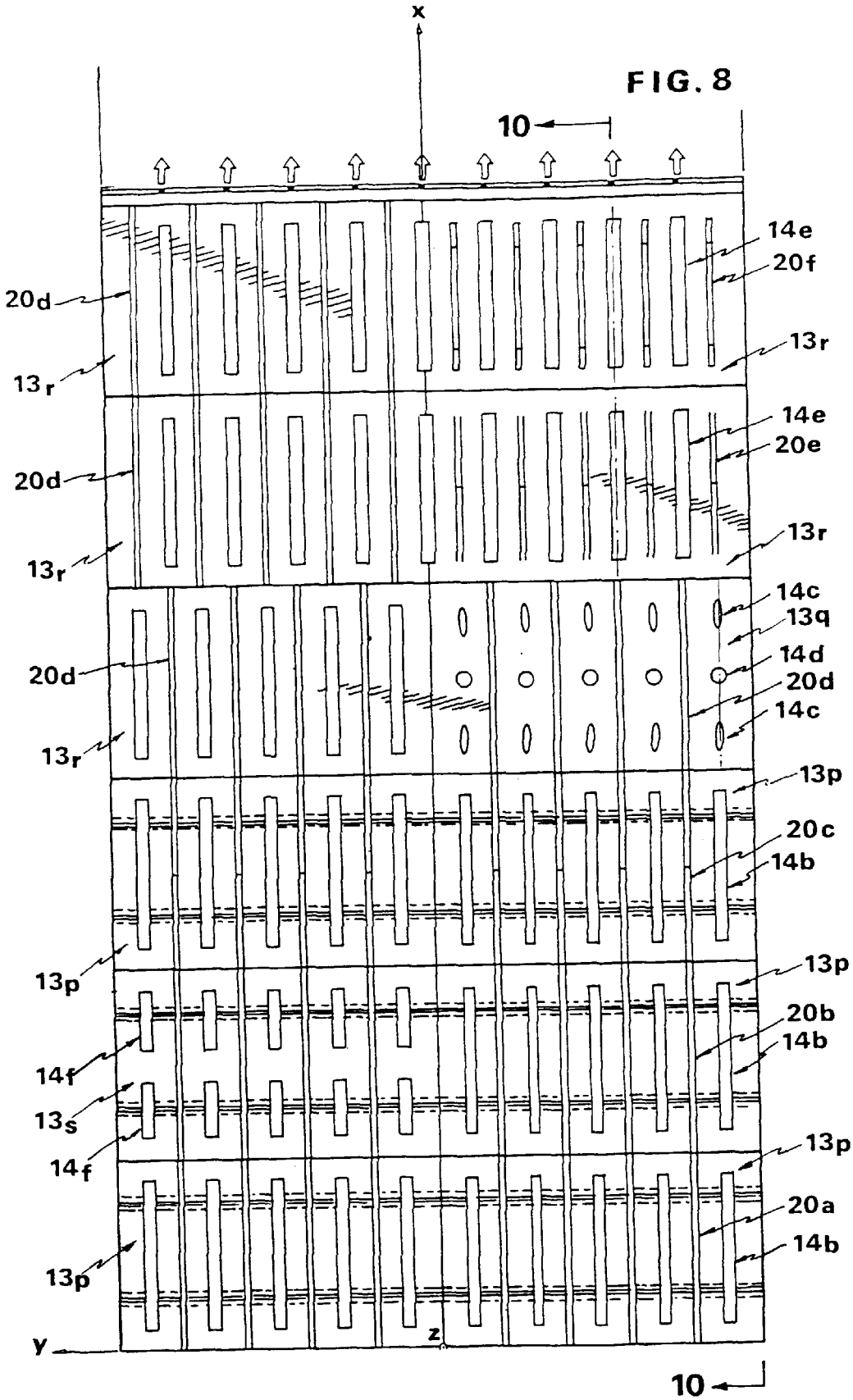
FIG. 8 is a plan view of rectangular-planform fire grates in accordance with the fourth and fifth versions of the fire grates of the present invention, each of the fire grates having straight fins thereon.

FIG. 8 is a plan view of the fourth version of the lower six rectangular fire grates 13*p*, 13*s* having first fluctuational-bottom straight fins and second fluctuational-bottom straight fins thereon and the fifth version of the upper six rectangular fire grates 13*q*, 13*r* having first fluctuation-free-bottom straight fins and second fluctuation-free-bottom straight fins thereon in accordance with the present invention. Contour of fire-grate upper surface of the lower six fire grates 13*p*, 13*s* is of fluctuational profile in "x" direction while that of the upper six fire grates 13*q*, 13*r* is of fluctuation-free profile in that direction.

Figure 9:
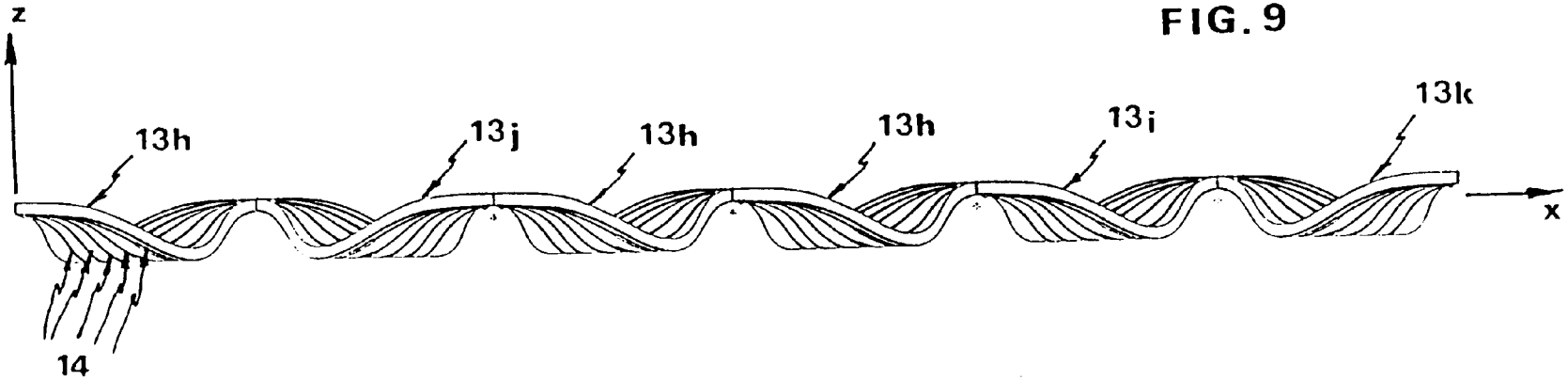
FIG. 9 is a side view of the rectangular-planform fire grates taken along 8—8 of FIG. 7.

FIG. 9 is a side view of the rectangular-planform fire grates taken along 9—9 of FIG. 7. One of advantages of these fire grates 13*h*, 13*i*, 13*j*, 13*k* over the fire grates of FIG. 1 is that the refuse fuel movement in "y" direction is easier due to gravitational effect. The ash discharge openings 14 may be of other shape when agitational feature is not provided to these fire grates having upper surface profile fluctuating bidirectionally.

Figure 10:
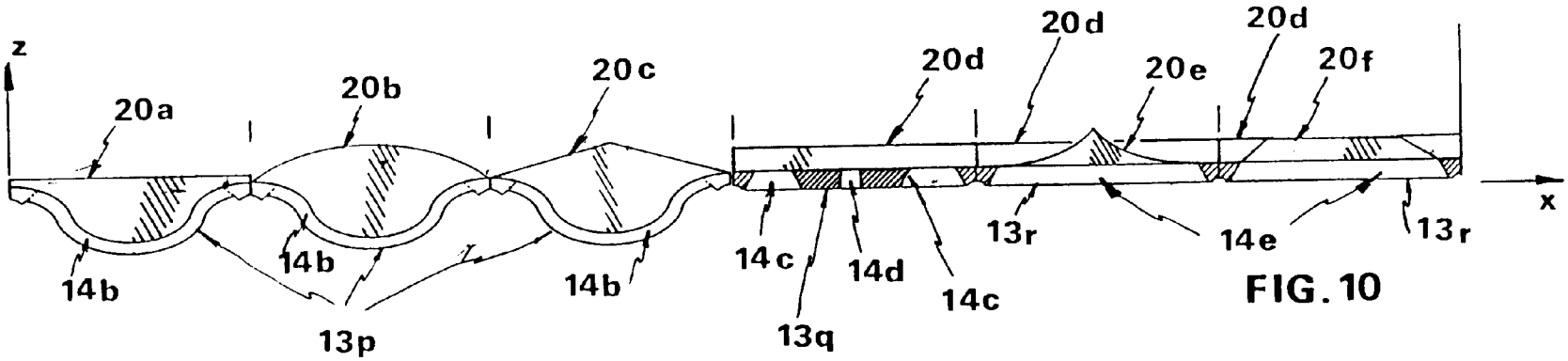
FIG. 10 is a side view and longitudinal sectional view taken along 10—10 of FIG. 9.

FIG. 10 is a side view of three embodiments to the fourth version of the fire grates having four sides of planform thereof and sectional view of three embodiments to the fifth version of the fire grates also having four sides of planform thereof, taken along 10—10 of FIG. 8.

The first fire grate 13*p* from left has thereon at least one first fluctuational-bottom straight fin 20*a* having fin upper surface contour of fluctuation-free profile in "x" direction and fin lower surface contour of the same profile as the profile of the contour of the fire-grate upper surface, and therein at least one ash discharge openings 14*b*.

Each of the second and third fire grates 13*p* has thereon at least one said second fluctuational-bottom straight fin 20*b*, 20*c* having fin upper surface contour of fluctuational profile in "x" direction and fin lower surface contour of the same profile as the profile of the contour of the fire-grate upper surface, and therein at least one ash discharge openings 14*b*.

The fourth fire grate 13*q* has thereon at least one said first fluctuation-free-bottom straight fin 20*d* having fin upper surface contour of fluctuation-free profile in "x" direction and fin lower surface contour of the same fluctuation-free profile of the contour of the fire-grate upper surface, and therein at least one combustion-agent admission hole 14*c* and at least one ash discharge openings 14*d*.

The fifth and sixth fire grate 13*r* has thereon respectively five said first fluctuation-free-bottom straight fins 20*d* and five said second fluctuation-free-bottom straight fins 20*e* having respective fin upper surface contour of fluctuation-free and fluctuational profile in "x" direction and fin lower surface contour of the same fluctuation-free profile of the contour of the fire-grate upper surface; and five said first fluctuation-free-bottom straight fins 20*d* and five said second fluctuation-free-bottom straight fins 20*f* having respective fin upper surface contour of fluctuation-free and fluctuational Profile in "x" direction, the first and second fluctuation-free-bottom straight fins being integrally disposed on the fire-grate upper surface.

Figure 11:
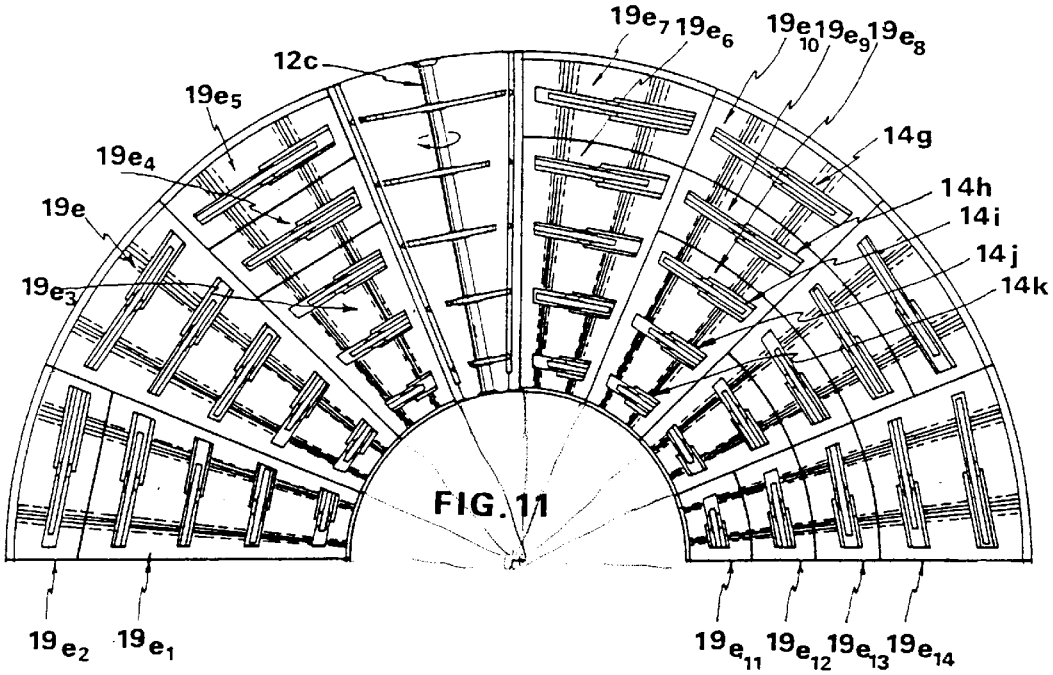
FIG. 11 is a half plan view of a circular-planform agitational stoker having thereon sixteen sectoral fire grates in accordance with the present invention.

FIGS. 11 is a half plan view of a circular agitational stoker having thereon sixteen circular sectoral fire grates 19*e* with ash discharge openings 14*g–k* therein in accordance with the present invention. The cost for manufacture of overall wood patterns for casting of the circular-planform fire grate may be cut down with radially fractional fire grates $\mathbf{19}e_{1\text{-}14}$, . . . while keeping the number of sectoring of sixteen.

Figure 12:
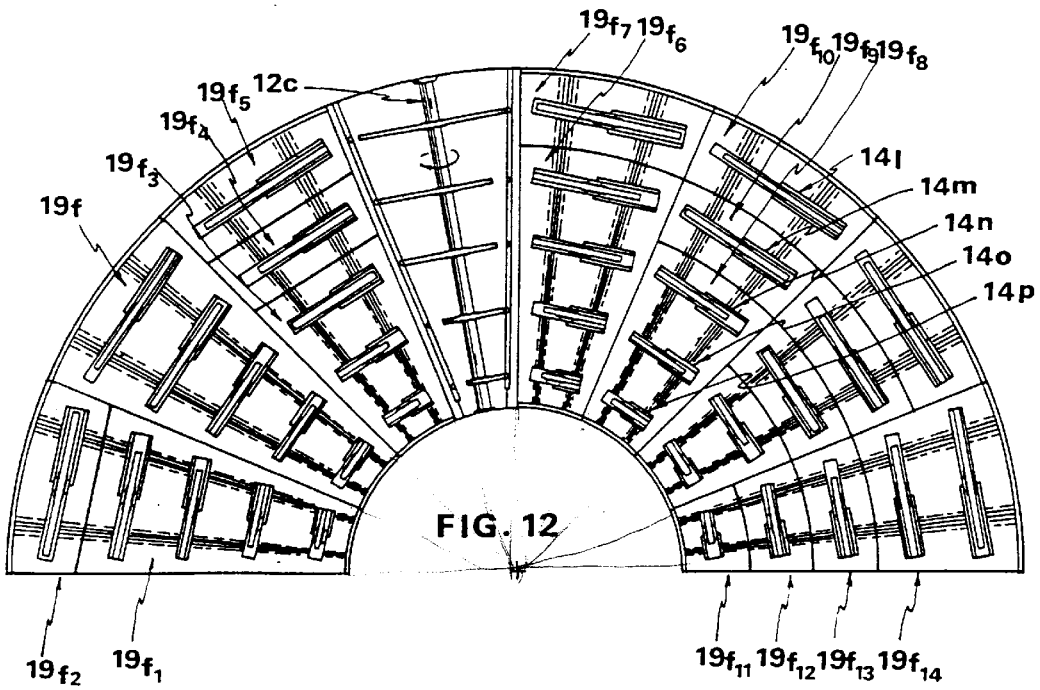
FIG. 12 is a half plan view of an another circular-planform agitational stoker having thereon sixteen sectoral fire grates in accordance with the present invention.

FIG. 12 is a half plan view of an another circular agitational stoker having thereon sixteen sectoral fire grates 19*f* with an alternative plan view of ash discharge openings 141-*p* in accordance with the present invention. Here again, The cost for having wide variety of diameter of circular-planform fire grates may be reduced with radially fractional fire grates $\mathbf{19}f_{1\text{-}14}$, . . . for circular planform combustion chamber. Waste material is incinerated on the fire grates 19*f* while performing overall circulatory motion due to agitational motion of agitation discs 11*f–j* (perspective view shown in FIG. 13)

FIG. 13 is a perspective view of one of the agitation rotors for the agitational stoker of FIG. 12. Two axially neighboring agitation discs have phase angle shift of 72 deg. between them in this embodiment of the agitation rotor. As the agitation rotor is driven rotationally in a rotational sense as indicated by an arrow, waste fuel on the fire grates 19*f* moves toward the center of the combustion chamber as well as in a counterclockwise direction when seen on the plan view of this circular-planform stoker as shown in FIG. 12.

FIG. 14 is a plan view of four sectoral fire grates 19*g*, 19*h*, 19*i* having ash discharge openings 14*r*, 14*s* therein and spider-web-planform fins thereon in accordance with the first and second version of the sectoral fire grate of the present invention.

The fire grate 19*h*, which is one embodiment again in compliance with the second version of the fire grate of the present invention, has thereon two sectoral first fluctuational-bottom spider-web-planform fins 21*b*, 21*c* having fin upper-surface contour of fluctuation-free profile and fin lower-surface contour of the same fluctuational profile as the profile of the contour of the fire-grate upper surface in the circumferential direction, and one sectoral second fluctuational-bottom spider-web-planform fin 21*d* having fin upper-surface contour of fluctuational profile and fin lower-surface contour of the same fluctuational profile as the profile of the contour of the fire-grate upper surface in the circumferential direction.

The fire grate 19*i*, which is another embodiment in accordance with the second version of the fire grate of the present invention, has thereon four of the sectoral second fluctuational-bottom spider-web-planform fins 21*e*, 21*f*, 21*g*.

The fire grate 19*g*, which is one embodiment to the first version of the fire grate of the present invention, has thereon two sectoral first fluctuation-free-bottom spider-web-planform fins 21*a* having fin upper-surface contour of fluctuation-free profile and fin lower-surface contour of the same fluctuation-free profile as the profile of the contour of the fire-grate upper surface in the circumferential direction, and two sectoral second fluctuation-free-bottom spider-web-planform fins $\mathbf{21}_I$ having fin upper-surface contour of fluctuational profile and fin lower-surface contour of the same fluctuation-free profile as the profile of the contour of the fire-grate upper surface in the circumferential direction Here, the second fluctuation-free-bottom spider-web-planform fin 21*a* has the same contour profile of fin upper surface as the second fluctuational-bottom spider-web-planform fin 21*b* integrally disposed on the upper surface of the fire grate 19*h*.

FIG. 15 is a radial sectional view of the fire grate 19*h* taken along 15—15 of FIG. 14, showing contours of the fin upper surface of the two first fluctuational-bottom spider-web-planform fins 21*b* and of the two second fluctuational-bottom spider-web-planform fins 21*c*, 21*d* integrally disposed on the upper surface of the fire grate 19*h*.

FIG. 16 is a plan view of four sectoral fire grates 19*j*, 19*k*, 191, 19*m* having alternative spider-web-planform fins 21*h*, 21*i*, 21*j*, 21*k* thereon and alternative ash discharge openings 14*t*, 14*u*, 14*v* therein.

The fire grates 19*k*, 191 have alternative plan view of ash discharge openings 14*t*, 14*u* therein and alternative two embodiments to the first fluctuational-bottom spider-web-planform fin 21*i*, 21*j* thereon in accordance with the second version of the sectoral fire grate of the present invention.

The fire grates 19*j* is an embodiment of the first version of the fire grate of the present invention having five ash discharge openings 14*v* therein and four embodiments to the second fluctuation-free-bottom spider-web-planform fin 21*h* thereon while the fire grate 19*m* has four embodiments to the first fluctuation-free-bottom spider-web-planform fin 21*k* thereon.

Finally, FIG. 17 is a plan view of four sectoral fire grates 19*n*, 19*o*, 19*p*, 19*q* having combustion-agent admission openings 14*y* and ash discharge openings 14*w*, 14*x* therein and the second fluctuational-bottom spider-web-planform fins and the second fluctuation-free-bottom spider-web-planform fins with the same fin upper-surface contour profile as shown in FIG. 16 thereon.

It is to be noted that the first and second fluctuational-bottom spider-web-planform fins as shown in FIG. 14 and the first and second fluctuational-bottom spider-web-planform fins as shown in FIG. 16 may be combinationally and integrally disposed on the upper surface of the sectoral fire grate of which the sectoral fire-grate upper surface is fluctuational in the circumferential direction of the incineration chamber wherein the sectoral fire grates are laid out in tiling fashion. Also the first and second fluctuation-free-bottom spider-web-planform fins as shown in FIG. 14 and the first and second fluctuation-free-bottom spider-web-planform fins as shown in FIG. 16 may also be combinationally and integrally disposed on the upper surface of the sectoral fire grate of which the sectoral fire-grate upper surface is fluctuation free in the circumferential direction of the incineration chamber wherein the sectoral fire grates are laid out in tiling fashion. It is also to be noted that the sectoral fire grate having at least one of the first and second fluctuational-bottom spider-web-planform fins thereon and the sectoral fire grate having at least one of the first and second fluctuation-free-bottom spider-web-planform fins thereon may also be combinationally arranged in circumferential direction of the incineration chamber.

According to the present invention as described above in detail, intimate-contact preventing means for the waste materials dumped on the circulr-planform fire grate can be provided to the fire grate so that virtually airborne incineration of waste materials is possible even without rigorous agitational mechanism. More thorough combustion-agent, inclusive of air, supply even into the dumped refuse on the fire grate in compliance with the present invention is possible with this stationary fire grate selectively having fluctuational and/or fluctuation-free spider-web-planform fins on the upper surface of the fire grate at certain radial spacings with a multiplicity of ash discharge openings therein in between them, resulting in increased incineration capacity and improved combustion efficiency. Even with plain circular fluctuation-free profile of the upper surface of the fire grate, lifting up feature for burning fuel virtually airborne can be provided if horizontal and/or fluctuational spider-web-planform fins are integrally disposed on the upper surface of the fire grate. A more thorough angular symmetry is obtained as the number of sectoral fire grates collectively forming a circualr-planform fire grate is increased for the first and second version of the fire grates of the present invention.

As the diameter of the fire grate increases, the circumferential distance between the two angularly circumferentially neighboring grate-supporting means, such as solid steel pipe, triangular brackets, or the integral combustion—agent supply pipings as disclosed in the drawings, increases resulting in reduced structural rigidity in radial direction of the incineration chamber wherein the fire grates are installed. The reduced structural rigidity in the vicinity of outer rim of each of the sectoral fire grates, in fact in the vicinity of inner shell of the combustion/incineration chamber, is compensated by having higher-section-modulus fin such as the one shown in FIG. 15.

While the specific embodiment of the invention described is for 16-cycle mode fire grates, it is believed obvious to those skilled in the art that lower- or higher-cycle mode stationary circular-planform fire grate can readily be constructed for lower or higher incineration capacity respectively or for meeting specific requirements of the characteristics of waste materials to be incinerated Having described a few embodiments of the 16-cycle mode circular-planform fire grate and of generally rectangular- or other polygonal-planform fire grates in accordance with the invention, it is believed obvious that other modifications and variations will be suggested to those skilled in the art in the light of the above teachings. It is therefore to be understood that changes may be made in the particular embodiment of the invention described which are within the full intended scope of the invention as defined by the appended claims.

What is claimed is:

1. An essentially circualr-sectoral-planform stationary fire grate having at least one ash discharge opening therein and means thereon for preventing refuse fuel being burned thereon from making intimate contact with upper surface of the fire-grate, contour of the fire-grate upper surface being of fluctuation-free profile in circumferential direction of the fire grate, the intimate-contact preventing means comprising at least one selected from a group consisting of:

(a) at least one sectoral first fluctuation-free-bottom spider-web-planform fin having fin upper-surface contour of fluctuation-free profile and fin lower-surface contour of the same fluctuation-free profile as the profile of the contour of the fire-grate upper surface in the circumferential direction, the first fluctuation-free-bottom spider-web-planform fin being integrally disposed on the fire-grate upper surface such that center of planform of the first fluctuation-free-bottom spider-web-planform fin essentially coincides with that of the fire grate; and (b) at least one sectoral second fluctuation-free-bottom spider-web-planform fin having fin upper-surface contour of fluctuational profile and fin lower-surface contour of the same fluctuation-free profile as the profile of the contour of the fire-grate upper surface in the circumferential direction, the second fluctuation-free-bottom spider-web-planform fin being integrally disposed on the fire-grate upper surface such that center of planform of the second fluctuation-free-bottom spider-web-planform fin essentially coincides with that of the fire grate.

2. An essentially circualr-sectoral-planform stationary fire grate having at least one ash discharge opening therein and means thereon for preventing refuse fuel being burned thereon from making intimate contact with upper surface of the fire-grate, contour of the fire-grate upper surface in circumferential direction and in radial direction of the fire grate being of fluctuational profile and of fluctuation-free profile respectively, the intimate-contact preventing means comprising at least one selected from a group consisting of:

(a) at least one sectoral first fluctuational-bottom spider-web-planform fin having fin upper-surface contour of fluctuation-free profile and fin lower-surface contour of the same fluctuational profile as the profile of the contour of the fire-grate upper surface in the circumferential direction, the first fluctuational-bottom spider-web-planform fin being integrally disposed on the fire-grate upper surface such that center of planform of the first fluctuational-bottom spider-web-planform fin essentially coincides with that of the fire grate; and (b) at least one sectoral second fluctuational-bottom spider-web-planform fin having fin upper-surface contour of fluctuational profile and fin lower-surface contour of the same fluctuational profile as the profile of the contour of the fire-grate upper surface in the circumferential direction, the second fluctuational-bottom spider-web-planform fin being integrally disposed on the fire-grate upper surface such that center of planform of the second fluctuational-bottom spider-web-planform fin essentially coincides with that of the fire grate.

3. A stationary fire grate having at least one ash discharge opening therein and at least four sides of planform thereof such that at least one pair of two sides of the at least four sides is essentially parallel to each other, contour of the fire-grate upper surface being of fluctuational profile such that a distance on the planform of the fire grate measured in a perpendicular direction from one of the sides to a point on the fire-grate upper surface where the fire-grate upper surface has the lowest elevation varies in magnitude thereof in a direction parallel to one of the sides.

4. A stationary fire grate having at least one ash discharge opening therein, means thereon for preventing refuse fuel being burned thereon from making intimate contact with upper surface of the fire-grate, and at least four sides of planform thereof such that at least one pair of two sides of the at least four sides is essentially parallel to each other, contour of the fire-grate upper surface being of fluctuational profile in a direction essentially normal to one of the sides, the intimate-contact preventing means comprising at least one selected from a group consisting of:

(a) at least one first fluctuational-bottom straight fin having fin upper surface contour of fluctuation-free profile and fin lower surface contour of the same profile as the profile of the contour of the fire-grate upper surface, the first fluctuational-bottom straight fin being integrally disposed essentially normal to one of the sides on the fire-grate upper surface; and (b) at least one second fluctuational-bottom straight fin having fin upper surface contour of fluctuational profile and fin lower surface contour of the same profile as the profile of the contour of the fire-grate upper surface, the second fluctuational-bottom straight fin being integrally disposed essentially normal to one of the sides on the fire-grate upper surface.

5. A stationary fire grate having at least one ash discharge opening therein, means thereon for preventing refuse fuel being burned thereon from making intimate contact with under surface of the fire-grate, and at least four sides of planform thereof such that at least one pair of two sides of the at least four sides is essentially parallel to each other, contour of the fire-grate upper surface being of fluctuation-free profile in a direction essentially normal to one of the sides, the intimate-contact preventing means comprising at least one selected from a group consisting of:

(a) at least one first fluctuation-free-bottom straight fin having fin upper surface contour of fluctuation-free profile and fin lower surface contour of the same fluctuation-free profile of the contour of the fire-grate upper surface, the first fluctuation-free-bottom straight fin being integrally disposed essentially normal to one of the sides on the fire-grate upper surface; and (b) at least one second fluctuation-free-bottom straight fin having fin upper surface contour of fluctuational profile and fin lower surface contour of the same fluctuation-free profile of the contour of the fire-grate upper surface, the second fluctuation-free-bottom straight fin being integrally disposed essentially normal to one of the sides on the fire-grate upper surface.

* * * * *